US006224191B1

(12) United States Patent
Saito et al.

(10) Patent No.: US 6,224,191 B1
(45) Date of Patent: May 1, 2001

(54) INK JET RECORDING HEAD

(75) Inventors: Asao Saito, Yokohama; Yoshinori Misumi, Tokyo; Masaki Oikawa, Kodaira, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/066,864

(22) Filed: Apr. 28, 1998

(30) Foreign Application Priority Data

May 7, 1997 (JP) ..... 9-132889

(51) Int. Cl.[7] ..... B41J 2/14; B41J 2/05
(52) U.S. Cl. ..... 347/48; 347/64
(58) Field of Search ..... 347/64, 65, 63, 347/67, 56, 57, 62

(56) References Cited

U.S. PATENT DOCUMENTS

| | | | | |
|---|---|---|---|---|
| 4,251,824 | * | 2/1981 | Hara et al. | 347/57 |
| 4,587,534 | | 5/1986 | Saito et al. . | |
| 5,157,419 | | 10/1992 | Matsumoto et al. . | |
| 5,479,197 | | 12/1995 | Fujikawa et al. | 347/63 |
| 5,481,287 | * | 1/1996 | Tachihara | 347/62 |
| 5,491,505 | | 2/1996 | Suzuki et al. | 347/203 |
| 5,580,468 | | 12/1996 | Fujikawa et al. | 216/27 |
| 5,600,356 | | 2/1997 | Sekiya et al. | 347/62 |
| 5,754,201 | * | 5/1998 | Ishinaga et al. | 347/62 |

FOREIGN PATENT DOCUMENTS

| | | | | |
|---|---|---|---|---|
| 0 350 953 | | 1/1990 | (EP) | B41J/2/16 |
| 0 707 964 | | 4/1996 | (EP) | B41J/2/05 |
| 0 747 221 | | 12/1996 | (EP) | B41J/2/05 |
| 0 750 991 | | 1/1997 | (EP) | B41J/2/14 |
| 63-34144 | * | 2/1988 | (JP) | 347/64 |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

An ink jet recording head of high printing quality including a plurality of electro-thermal transducers arranged on a substrate corresponding to respective nozzles, wherein each protective layer placed on a resistor constituting each of the plurality of electro-thermal transducers has a thickness-reduced portion at a part thereof so as to increase the distance between the center point of the air bubble of each of the plurality of electro-thermal transducers to longer than the distance between the centers of gravity of each of the plurality of electro-thermal transducers. With the ink jet recording head, the relationship between the amount and the speed of ejected ink droplets can be optimized in accordance with the size of areas of the electro-thermal transducers.

5 Claims, 10 Drawing Sheets

PRIOR ART

PRIOR ART

*PRIOR ART*

PRIOR ART

INK JET RECORDING HEAD

BACKGROUND OF THE INVENTION

1. Field of the Invention

The present invention relates to an ink jet recording head, and more particularly, to a so-called gradation-controllable ink jet head in which a plurality of electro-thermal transducers are arranged on respective nozzles for ejecting ink droplets, whereby the amount of the ejected ink droplets can be changed in accordance with image data.

2. Description of the Related Art

Hitherto, there have been two typical systems for constituting an ink jet head: a piezoelectric system utilizing a piezoelectric element, and a bubble jet system in which an electro-thermal transducer is formed on a substrate and nozzles are formed thereon.

A description will be given of modulation of the amount of the ejected ink droplets relating to an object of the present invention described below.

The piezoelectric system can control the amount of the ejected ink droplets within a relatively wide range by modulating a driving waveform of the piezoelectric element, and is suitable for controlling gradation. However, since the piezoelectric element is utilized, the manufacturing process thereof becomes complicated and the system is not so suitable for a high-density arrangement of nozzles.

The bubble jet system has high productivity and excellent high-density arrangement of the nozzles as compared with the above piezoelectric system, and is suitable for producing a high-speed ink jet head at a low cost. It is difficult, however, for the bubble jet system to modulate the amount of the ejected ink droplets. Thus, as a gradation control art in the bubble jet system, a multi-level system has been proposed in which the density of the nozzle arrangement is increased, the amount of the ejected ink droplets is decreased to, for example, about 10 picoliters, and one pixel is represented by many dots.

The multilevel system, however, encounters the following problems. Since the pixel is constituted by fine ink droplets as described above, the number of droplets-driving pulses increases in accordance with the number of dots, thereby shortening the life of the ink jet head. In addition, at the head driving frequency which is the same as that of the conventional head, the recording speed is decreased.

In order to solve the foregoing problems, an ink jet head is proposed in which a plurality of electro-thermal transducers are arranged in one nozzle, and the electro-thermal transducers are actuated as needed, thereby changing the amount of the ejected ink droplets.

The structure of the above conventional ink jet head is shown in FIG. 2. In addition, FIG. 3 shows a cross-sectional configuration of the portion of the electro-thermal transducer taken along the line A–A' of FIG. 2.

Referring to the drawings, a resistive layer 4 formed by a resistor material, such as $HfB_2$, a wiring layer 5 formed of Al, and a protective layer 6 formed of insulating material, such as $SiO_2$ are formed on a silicon substrate having a heat storage layer formed thereon. Although a cavitation resistant layer and a protective layer, etc. are further formed thereon, they are omitted from the drawing.

The above conventional ink jet head encounters the following problems.

In the ink jet head in which a plurality of electro-thermal transducers 2 are arranged in one nozzle 1, it is possible to actuate a necessary electro-thermal transducer 2 and to change the volume of an air-bubble in accordance with a necessary amount of ejection in order to change the heat generating area of the electro-thermal transducer 2. The nozzle 1 ejecting the ink droplets is, however, common to each of the electro-thermal transducers 2. Therefore, it is difficult to optimally design the nozzle 1 corresponding to individual amounts of ejection. Particularly, since an ejection port 11 of the tip of the nozzle 1 is fixed, it is almost impossible to optimize the amount of ejection and ejection speed simultaneously.

In order to solve the foregoing problems, the position of the electro-thermal transducers may be changed. This is intended to obtain a necessary amount of ejection and ejection speed by optimizing each of the center points of air bubbles in the electro-thermal transducers.

FIG. 10 shows the relationship between the ejection speed and the amount of ejection when the center of gravity of the electro-thermal transducer is changed. More specifically, FIG. 10 shows the amount of ejection and the ejection speed when a small-area heater and a large-area heater of the electro-thermal transducer are actuated singly and in combination.

It is apparent from FIG. 10 that the amount of ejection and the ejection speed change in response to the area of the electro-thermal transducer, but they are in a direct proportional relationship.

In other words, it is understood that the ejection speed increases when the electro-thermal transducer is located forward of the nozzle ($L=50\mu$) as compared with when located rearward of the nozzle ($L=100\mu$) in spite of an equivalent amount of ejection.

In addition, as the amount of ejection decreases, the ejection speed decreases. In the most extreme case of decrease, only about 2 to 3 m/s could be obtained. With such properties, it is difficult to maintain reliability.

As described above, the center of gravity of the electro-thermal transducer in relation to the position of the nozzle is a large determinant of the amount of ejection and the ejection speed.

However, in order to satisfy ejection performance required for product specifications, the degree of freedom of design parameters is limited.

For example, in order to achieve a target drive frequency, the entire length of the nozzle should be short to some extent.

In addition, in order to achieve the target amount of ejection, a necessary volume of air bubble should be secured, so that the area of the electro-thermal transducer is determined.

Therefore, even if the position of the electro-thermal transducer is to be changed as described above, it is often impossible to place the electro-thermal transducer in a given nozzle while securing a necessary area of the electro-thermal transducer.

In FIG. 2, for example, two electro-thermal transducers 2 are arranged in one nozzle 1 so as to obtain the ejection amounts of 40 picoliters and 80 picoliters.

In order to achieve an ejection amount of 40 picoliters, an area of about 2000 square microns is required, and an area of about 4000 square microns is required in order to achieve an ejection amount of 80 picoliters, although they are depend on the driving condition of the electro-thermal transducers 2.

To arrange these electro-thermal transducers 2 in the same nozzle 1, the width of the heater is defined due to the restriction in size, so that the length of the heater is also defined.

For example, in order to obtain the above areas, the heaters having a size of 16μ125μ, and a size of 22μ×178μ are required, respectively.

When these two electro-thermal transducers 2 are to be arranged by shifting by 100μ, the entire length of the heater portions thereof becomes 278μ. For example, when they are to be arranged in a nozzle having a length of 300μ, the rear end of the heater portion will protrude from the nozzle and hence, it is impossible to eject properly the ink droplets. Therefore, the amount of shift of the electro-thermal transducers should be reduced.

FIG. 11 illustrates the above-described arrangement of the electro-thermal transducers.

As is apparent from the drawing, the rear end of an air bubble protrudes from a nozzle region at timing when the volume of the air bubble is maximum.

SUMMARY OF THE INVENTION

Accordingly, it is an object of the present invention to provide an ink jet recording head of high printing quality including a plurality of electro-thermal transducers provided on a substrate corresponding to respective nozzles, wherein the relationship between the amount and the speed of ejected ink droplets can be optimized in accordance with the size of areas of the electro-thermal transducers.

According to an aspect of the present invention, there is provided an ink jet recording head including a plurality of electro-thermal transducers arranged on a substrate corresponding to respective nozzles, wherein each protective layer placed on a resistor constituting each of the plurality of electro-thermal transducers has a thickness-reduced portion at a part thereof so as to increase the distance between the center point of the air bubble of each of the plurality of electro-thermal transducers to longer than the distance between the centers of gravity of each of the plurality of electro-thermal transducers.

In the ink jet recording head, the plurality of electro-thermal transducers may be arranged in parallel with, or in line with each other, and each of the thickness-reduced portions is placed at a position shifted from the center of gravity of the resistor to increase the distance therebetween.

In the ink jet recording head, the thickness-reduced portion of a small-area heater may be located on the side of an ejection port which is placed forward of the center of gravity of the resistor, and the thickness-reduced portion of a large-area heater may be located rearward of the center of gravity of the resistor, thereby optimizing the relationship between the amount and the speed of the ejected ink droplets in accordance with the size of areas of the electro-thermal transducers.

In the ink jet recording head, the thickness-reduced portion may be arranged or shaped so as to avoid a cavitation portion which occurs during debubbling.

The present invention is configured as described above. More specifically, a partial reduction in thickness of the protective layer constituting the electro-thermal transducer moves the point of action of an air bubble to the forward or rearward of the center of the electro-thermal transducer, thereby making it possible to increase the difference in distribution ratios of flow resistance of nozzles forward and rearward of respective points of action of the air bubble of a plurality of electro-thermal transducers to higher than the difference in distribution ratios of flow resistance of nozzles forward and rearward of respective centers of gravity.

In other words, with the described arrangement, the point of action of the air bubble of the small-area heater can be placed in a more forward position, and the point of action of the air bubble of the large-area heater can be placed in a more rearward position.

Therefore, the speed of the ink droplets ejected by the small-area heater is increased, whereas the speed of the ink droplets ejected by the large-area heater is decreased.

Consequently, the ejection energy increases and the ejection reliability is further increased in the ejection of small ink droplets, and a state of excessive ejection energy is prevented in the election of large ink droplets, thereby enabling the formation of a normal image and the realization of an ink jet recording head of high printing quality.

Further objects, features and advantages of the present invention will become apparent from the following description of the preferred embodiments with reference to the attached drawings.

DESCRIPTION OF THE PREFERRED EMBODIMENT

Figure 1:
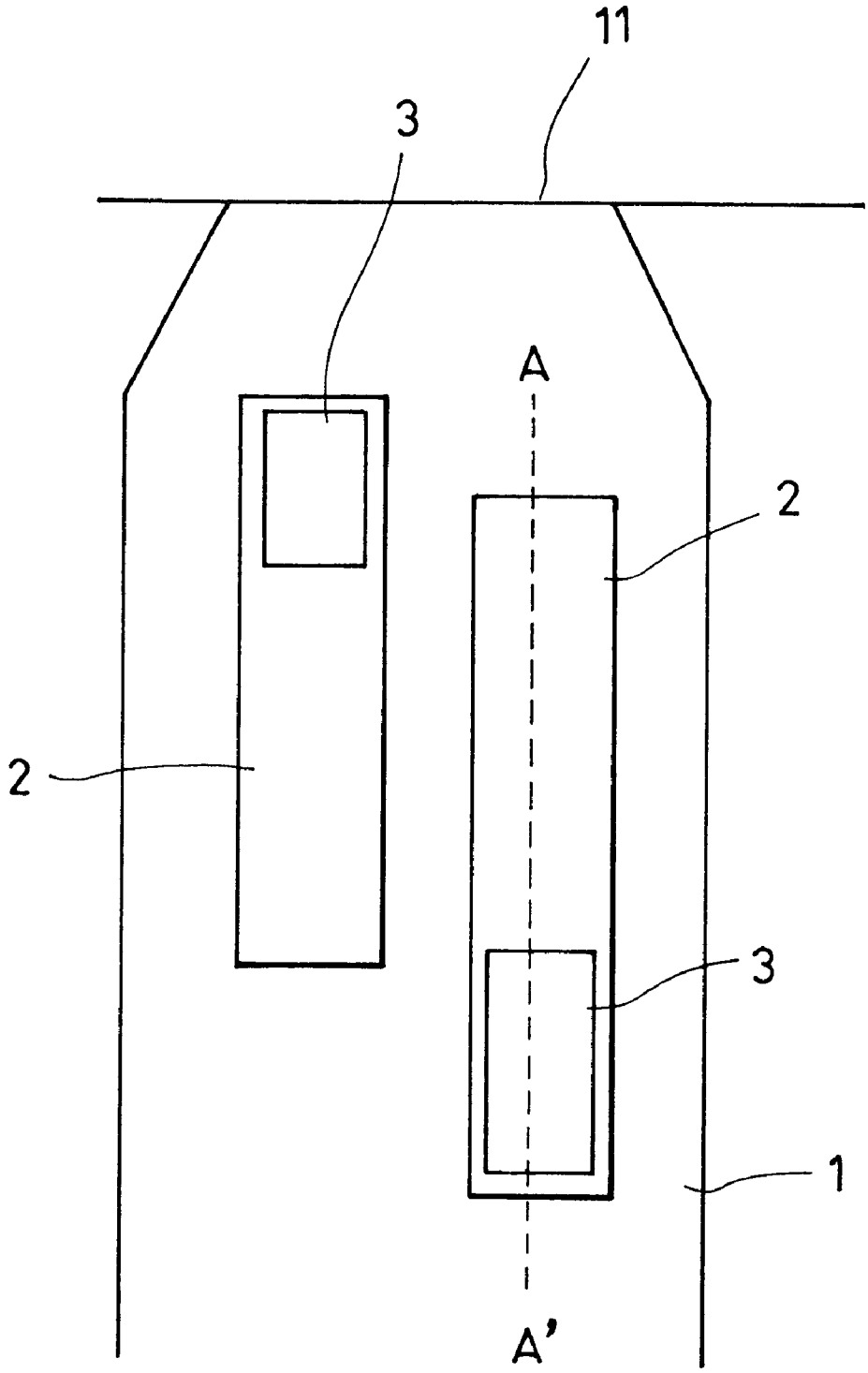
FIG. 1 is an illustration of a first embodiment of the present invention.
Figure 2:
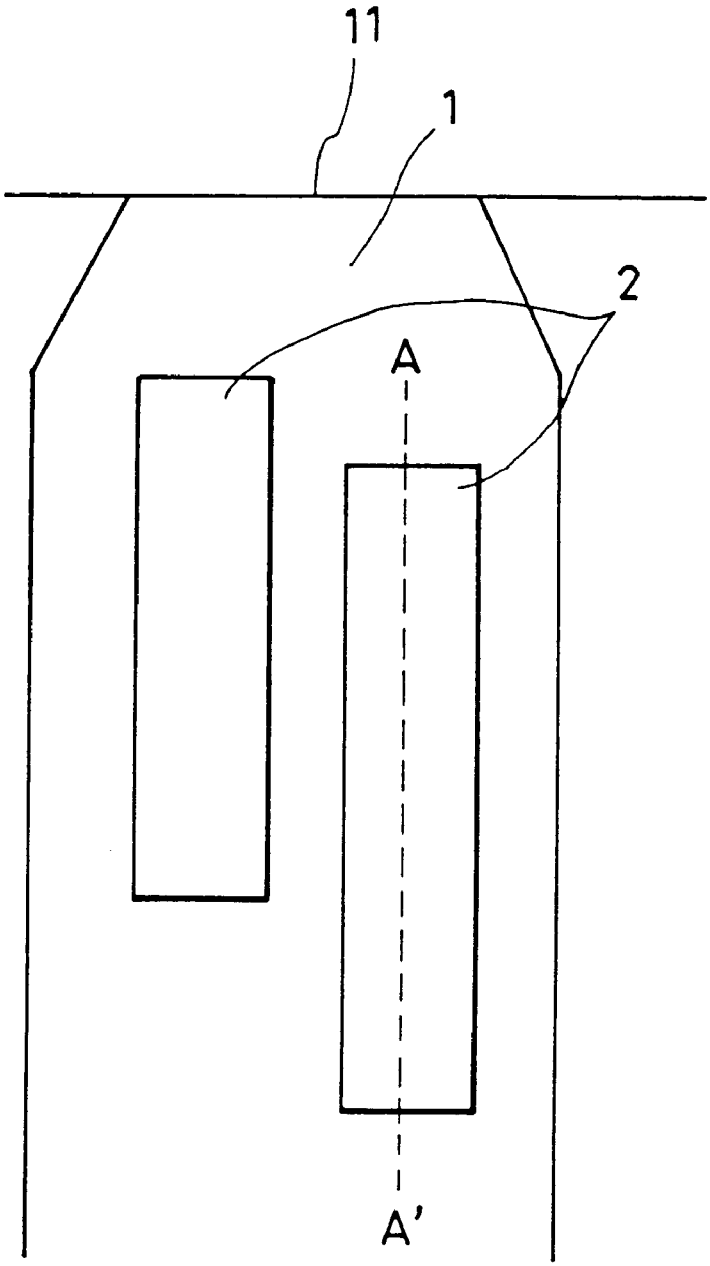
FIG. 2 is an illustration relating to a conventional art.
Figure 3:
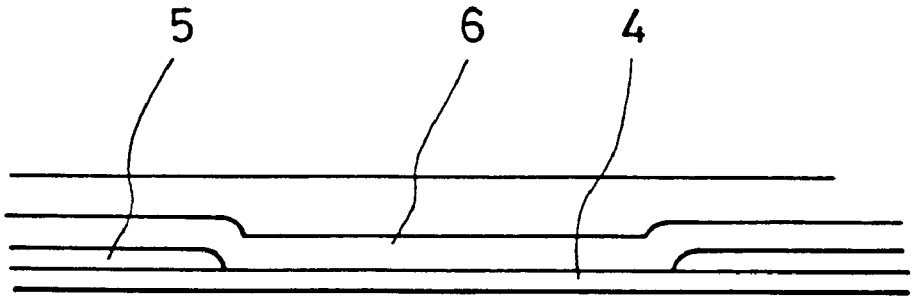
FIG. 3 is an illustration relating to the conventional art shown in FIG. 2.
Figure 4:
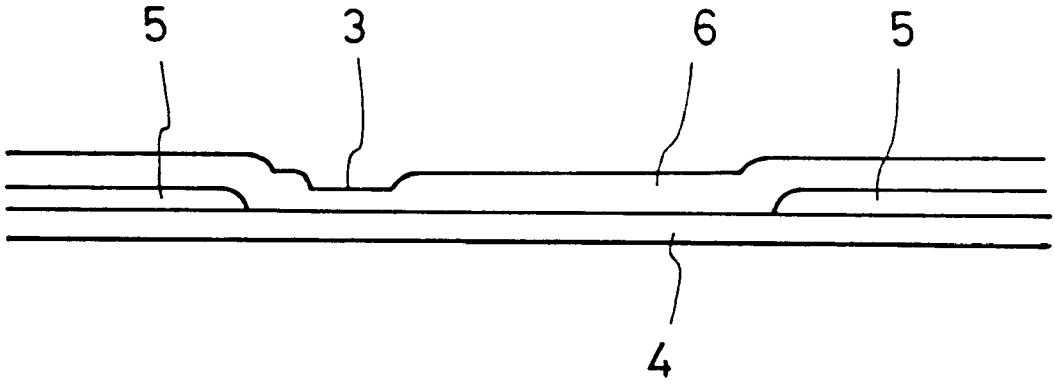
PRIOR ART FIG. 4
FIG. 4 is an illustration of the first embodiment of the present invention.
Figure 5A:
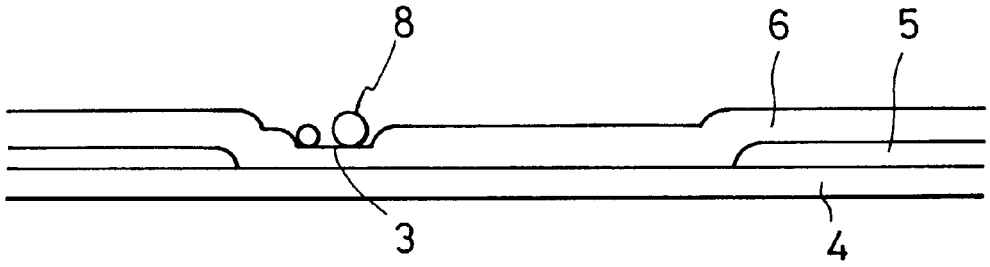
FIGS. 5A to 5D are illustrations of the first embodiment of the present invention.
Figure 5B:
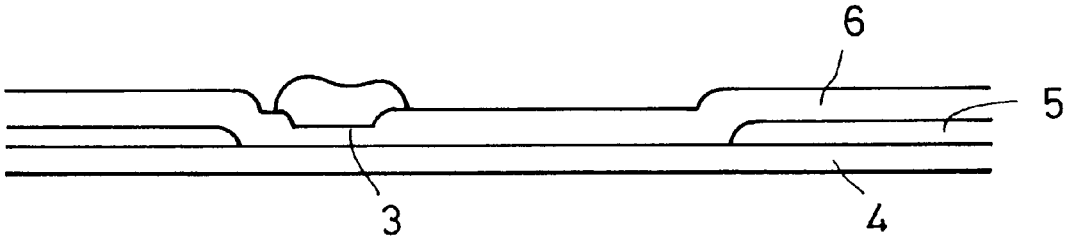
Figure 5C:
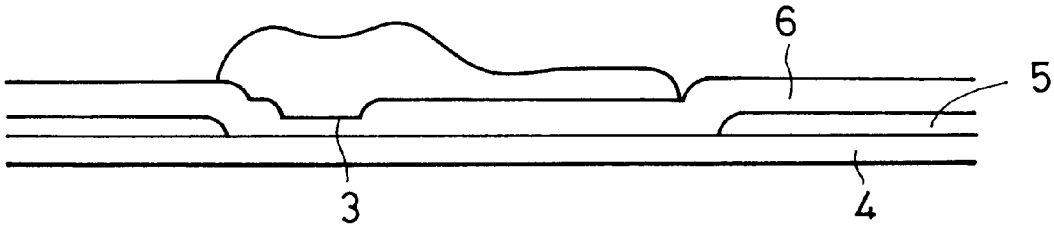
Figure 5D:
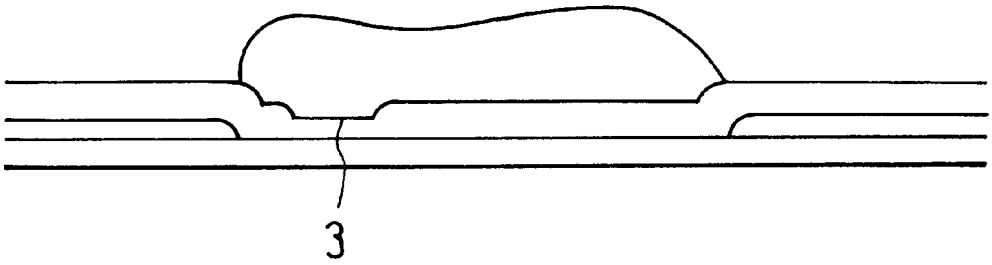

FIG. 1 shows a first embodiment of the present invention. Referring to FIG. 1, electro-thermal transducers 2 are arranged in parallel with each other in a nozzle 1 of an ink jet head. A cross-sectional configuration of the electro-thermal transducer 2 taken along the line A–A' is shown in FIG. 4. In this embodiment, as compared with the structure of the conventional ink jet head, a protective layer 6 has a thickness-reduced portion 3 provided on a part of the upper surface of a resistive layer 4.

Such a thickness-reduced portion 3 is formed by etching again only the portion to be reduced in thickness after the patterning of the protective layer 6 in a substrate-manufacturing step.

An air bubble occurrence condition when ink droplets are ejected using the thus obtained electro-thermal transducers is shown in FIGS. 5A to 5D.

The partial reduction in thickness of the protective layer 6 produces an air bubble 8 at the thickness-reduced portion 3 of the protective layer 6 earlier than a thick portion. The air bubble 8 grows around the thickness-reduced portion 3, and finally spreads over the entire effective surface of the electro-thermal transducer.

By forming the thickness-reduced portion 3, the point of action (center) of the air bubble 8 can be moved to the side of a thin layer region and a necessary air bubble volume can be obtained. This allows the center of the air bubble to be located forward or rearward from the actual position where the electro-thermal transducers 2 are arranged, thereby achieving a more preferable relationship from the design viewpoint between the amount of ejection and ejection speed due to the change of the center of gravity of the electro-thermal transducer shown in FIG. 10.

In this embodiment shown in FIG. 1, the thickness-reduced portion 3 of the electro-thermal transducer 2 located forward of the nozzle 1 is placed on the side of an ejection port 11, thereby reducing the amount of ejected ink droplets and increasing the ejection speed.

Conversely, the thickness-reduced portion 3 on the electro-thermal transducer 2 located rearward of the nozzle 1 is placed in rearward of the nozzle 1, thereby preventing an excessive increase in the ejection speed while securing a large amount of the ejected ink droplets.

With the described design of the ink jet head, the ejection speed of small droplets which are ejected in small amounts is increased to higher than that of small droplets ejected from the conventional ink jet head, resulting in the achievement of an operation with a high degree of reliability.

In addition, by preventing an excessive increase in the ejection speed of large droplets which are ejected in large amounts, the shape of the ejected droplets is stabilized, resulting in the reduction of satellite ink droplets and ink mist on a printing paper, and in the increase in printing quality.

Figure 6:
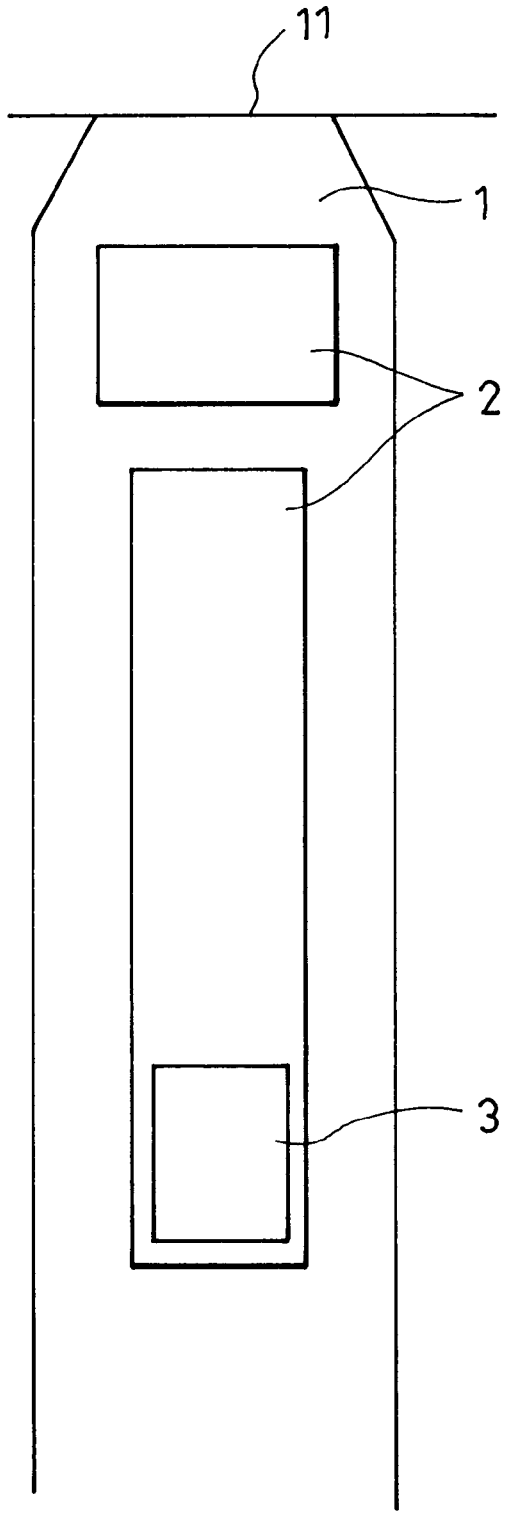
FIG. 6 is an illustration of a second embodiment of the present invention.

FIG. 6 shows a second embodiment of the present invention. Referring to FIG. 6, electro-thermal transducers 2 are arranged in series in the nozzle 1 of the ink jet head 1.

In the embodiment shown in FIG. 1, since the electro-thermal transducer 2 located forward of the nozzle 1 is arranged sufficiently near the side of the ejection port 11, there is no need to set the point of action of the air bubble at a forward position by providing the thickness-reduction portion 3.

In this embodiment, however, the thickness-reduced portion 3 is provided on the electro-thermal transducer 2 located on the rearward position of the nozzle 1 so as to prevent an excessive increase in the ejection speed while securing a large amount of ejection.

With the described design of the ink jet head, an excessive increase in the ejection speed of the large droplets which are ejected in large amounts is prevented, thereby stabilizing the shape of the ejected droplets, resulting in the reduction of satellite ink droplets and ink mist on a printing paper and in the increase in printing quality.

Of course, the thickness-reduced portion 3 may be provided on both of the electro-thermal transducers 2.

Figure 7:
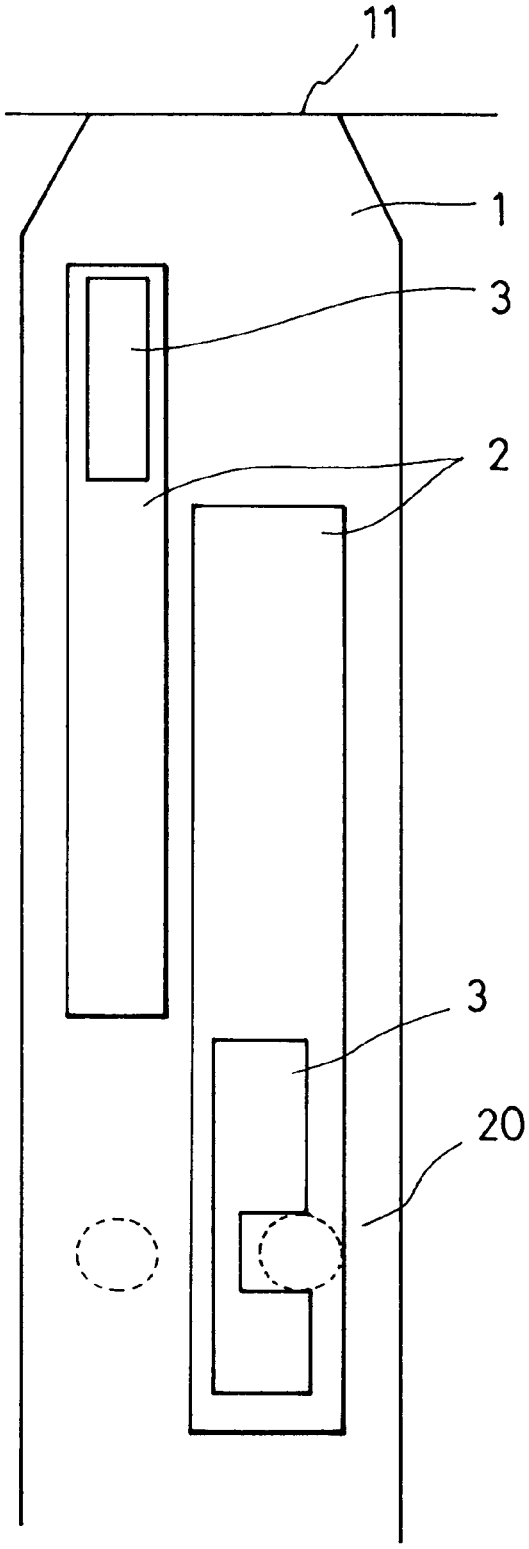
FIG. 7 is an illustration of a third embodiment of the present invention.

FIG. 7 shows a third embodiment of the present invention.

One of the problems of the ink jet head of a bubble-jet system is the breakage of the protective layer 6 caused by cavitation which occurs during debubbling.

Figure 8:
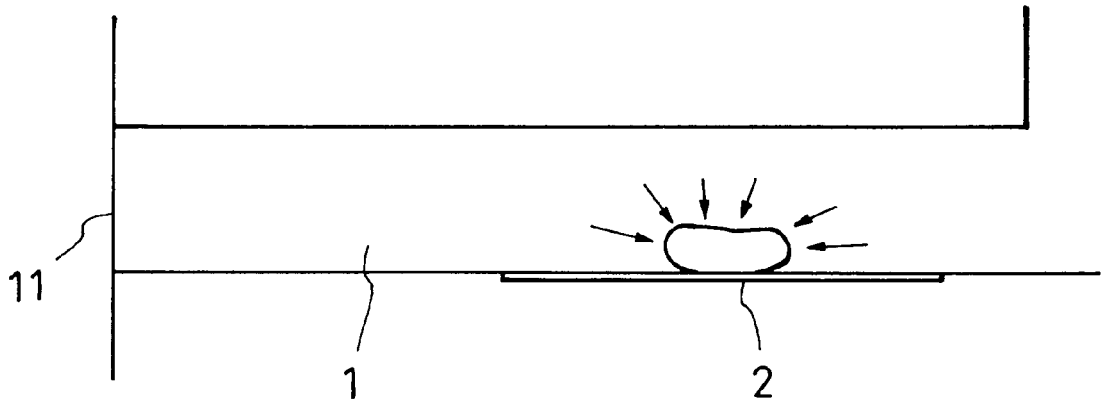
FIG. 8 is an illustration of the third embodiment of the present invention.

This will be described in detail. A cavitation occurs during debubbling as shown in FIG. 8, and a shock wave strikes the surface of the protective layer to gradually damage the protective layer. Thus, the protective layer is broken, the wiring layer is exposed to cause electrolytic corrosion, and eventually the ink jet head is broken.

In order to solve the foregoing problem, a measure such as the provision of a cavitation resistant layer has been proposed. However, at a step portion of the layer, step coverage decreases, so that such a measure is not so effective.

In this embodiment, a cavitation-concentrating portion 20 is avoided, the position of the thickness-reduced portion 3 or the shape thereof is contrived so as to be unaffected by the cavitation.

As described above, according to the present invention, the relationship between the amount and the speed of the ejected ink droplets can be optimized in accordance with the size of the areas of the electro-thermal transducers. More particularly, a thickness-reduced portion of the protective layer is located forward of the center of the electro-thermal transducer, whereby the ejection speed of the ink droplets is increased and the reliability thereof is increased in the small-area heater, and the thickness-reduced portion is located rearward of the center of the electro-thermal transducer so that the ejection speed is decreased and excessive ejection energy is prevented in the large-area heater, thereby enabling the formation of a normal image and the realization of an ink jet recording head of high printing quality.

In addition, the position of the thickness-reduced portion, or the shape thereof is contrived, whereby a cavitation-concentrating portion can be avoided.

Further, by enabling the detection of outputs of temperature sensors of all of the substrates, temperatures can be controlled in more precisely. Still further, by selectively actuating a heat preserving heater as needed, the temperatures can be controlled in more precisely, so that image quality can be increased, unevenness of density can be prevented, and operation reliability can be increased.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink jet recording head comprising a plurality of electro-thermal transducers arranged on a substrate corresponding to respective nozzles, each transducer having a resistor and a protective layer placed on said resistor, wherein said protective layer has a thickness-reduced portion at a part thereof so as to increase a distance between center points of respective air bubbles of each of said plurality of electro-thermal transducers to longer than a distance between the centers of gravity of each of said plurality of electro-thermal transducers.

2. An ink jet recording head according to claim 1, wherein said plurality of electro-thermal transducers are arranged in parallel with each other, and each of said thickness-reduced portions is placed at a position shifted from the center of gravity of said resistor to increase the distance therebetween.

3. An ink jet recording head according to claim 1, wherein said plurality of electro-thermal transducers are arranged in line with each other, and each of said thickness-reduced portions is placed at a position shifted from the center of gravity of said resistor to increase the distance therebetween.

4. An ink jet recording head according to any one of claim 1 to 3, wherein said thickness-reduced portion of a small-area heater is located on a [the] side of an ejection port which is placed forward of the center of gravity of said resistor, and said thickness-reduced portion of a large-area heater is located rearward of the center of gravity of said resistor.

5. An ink jet recording head according to any one of claim 1 or 3, wherein said thickness-reduced portion is arranged or shaped so as to avoid a cavitation portion which occurs during debubbling.

* * * * *

UNITED STATES PATENT AND TRADEMARK OFFICE

CERTIFICATE OF CORRECTION

PATENT NO. : 6,224,191 B1
DATED : May 1, 2001
INVENTOR(S) : Asao Saito et al.

Figure 10:
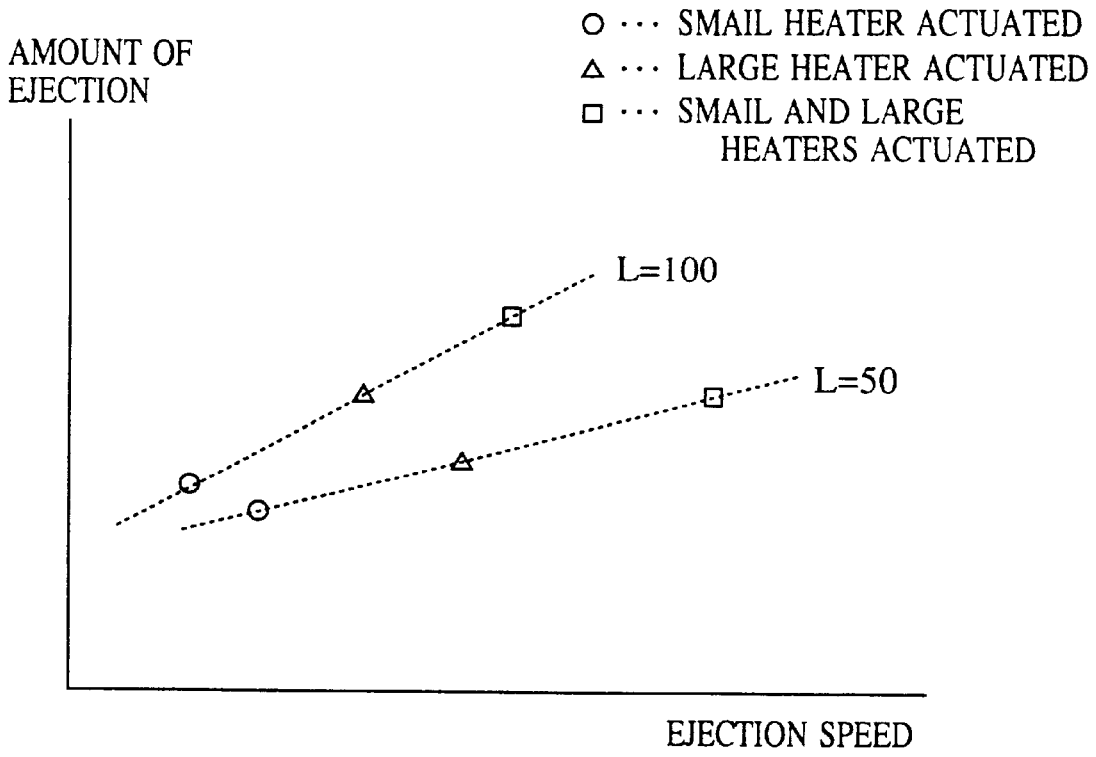
FIG. 10 is an illustration relating to the conventional art.
Figure 11:
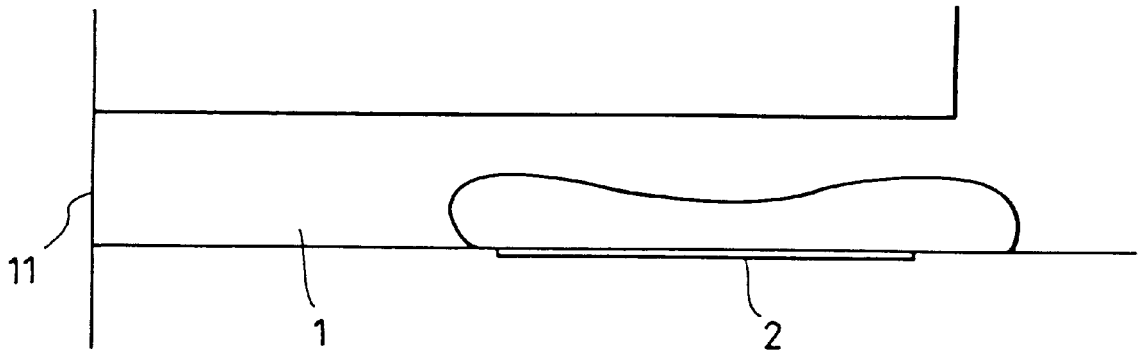
FIG. 11 is an illustration relating to the conventional art.

It is certified that error appears in the above-identified patent and that said Letters Patent is hereby corrected as shown below:

Sheet 9,
Fig. 10, "SMAIL" (both occurrences) should read -- SMALL --.

Column 1,
Line 61, "etc." should read -- etc., --.

Column 2,
Line 61, "are" should be deleted.

Column 3,
Line 2, "16μ125μ," should read -- 16μ X 125μ, --; and
Line 15, "timing" should read -- a time --.

Figure 9:
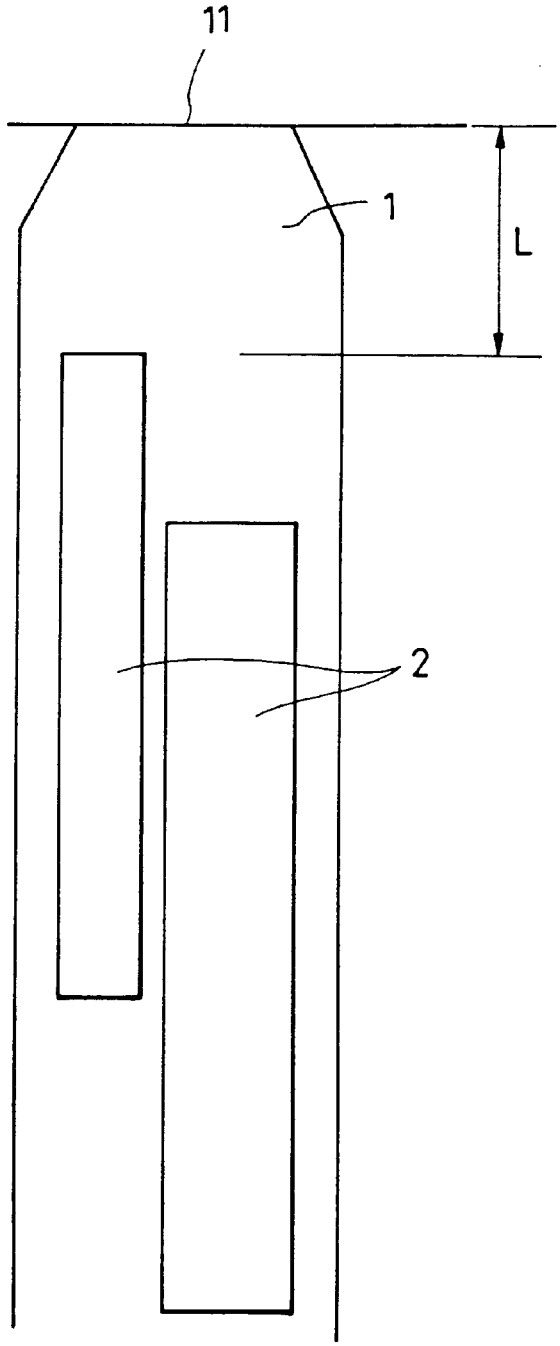
FIG. 9 is an illustration relating to another conventional art.

Column 4,
Line 39, "art;" should read -- art shown in FIG. 9; --;
Line 41, "art." should read -- art shown in Fig. 9. --; and
Line 64, "a" should read -- at a --.

Column 5,
Line 34, "ink jet head 1." should read -- ink jet head. --.

Column 6,
Line 5, "avoided," should read -- avoided, and --;
Line 27, "in" should be deleted;
Line 29, "in" should be deleted;
Line 64, "claim" should read -- claims --; and
Line 66, "[the]" should be deleted.

UNITED STATES PATENT AND TRADEMARK OFFICE

CERTIFICATE OF CORRECTION

PATENT NO. : 6,224,191 B1
DATED : May 1, 2001
INVENTOR(S) : Asao Saito et al.

It is certified that error appears in the above-identified patent and that said Letters Patent is hereby corrected as shown below:

Column 7,
Line 3, "claim" should read -- claims --; and
Line 4, "or" should read -- to --.

Signed and Sealed this

Eighth Day of January, 2002

*Attest:*

*Attesting Officer*

JAMES E. ROGAN
*Director of the United States Patent and Trademark Office*